US005249856A

United States Patent [19]

Dreier

[11] Patent Number: 5,249,856

[45] Date of Patent: Oct. 5, 1993

[54] KITCHEN CORNER CUPBOARD

[75] Inventor: Horst Dreier, Haar, Fed. Rep. of Germany

[73] Assignee: Dreier Kuechen und Einrichtungszentrum GmbH & Co. KG, Haar bei Muenchen, Fed. Rep. of Germany

[21] Appl. No.: 672,263

[22] Filed: Mar. 20, 1991

[30] Foreign Application Priority Data

Mar. 21, 1990 [DE] Fed. Rep. of Germany ..... 4009150
May 4, 1990 [DE] Fed. Rep. of Germany ..... 4014375

[51] Int. Cl.[5] ..... A47B 97/00

[52] U.S. Cl. ..... 312/238; 312/305; 211/163

[58] Field of Search ..... 312/125, 135, 267, 238, 312/305; 211/131, 144, 163

[56] References Cited

U.S. PATENT DOCUMENTS

| | | | |
|---|---|---|---|
| 2,570,747 | 10/1951 | Bailey | 312/238 X |
| 2,629,643 | 2/1953 | Davidson | 211/144 X |
| 3,160,453 | 12/1964 | Tassell | 312/238 |
| 4,433,885 | 2/1984 | Baker | 312/125 X |

FOREIGN PATENT DOCUMENTS

| | | | |
|---|---|---|---|
| 2722629 | 9/1978 | Fed. Rep. of Germany | 312/238 |

*Primary Examiner*—Kenneth J. Dorner
*Assistant Examiner*—Brian K. Green
*Attorney, Agent, or Firm*—Townsend and Townsend, Khourie and Crew

[57] ABSTRACT

A kitchen corner cupboard comprises a housing (12) having an upper cover plate (11) and a carousel (13) mounted therein. The carousel is provided with a vertical rotation shaft (15) which mounts at least one circular horizontal carrier plate (14*a*, 14*b*), in particular concentric to the rotation shaft (15) and a front element (18) made of two front panels (19, 20) arranged preferably at right angles or at an angle of 180° to each other. The rotation shaft (15) lies at a substantial distance behind the intersection line of the imaginary extension of the front panels (41, 42) of adjacent cupboard housings. For the opening of the housing (12) the rotation shaft (15) is rotatably journalled about a vertical axis (17) at its lower end region on a diagonal translation body (25) which is diagonally translatably mounted on a base body (16) of the housing (12). In the closed rotary position of the front element (18), the rotation shaft is translatable diagonally, i.e. at an angle of preferably 45°, with respect to the front panels (41, 42) of adjacent cupboard housings between the closed position in which the front element (18) adjoins on either sides the front panels (41, 42) of the adjacent cupboard housings, and a position ready for rotation in which the carousel (13) can be rotated without the risk of a collision of the vertical edges (23, 24) of the cornered front (18) against the side walls (21, 22) of the housing (12).

17 Claims, 8 Drawing Sheets

KITCHEN CORNER CUPBOARD

BACKGROUND OF THE INVENTION

The invention relates to a corner cupboard, in particular a kitchen corner cupboard according to the preamble of claim 1.

In a known kitchen corner cupboard of this kind (DE-PS 27 22 629), in order to avoid a collision of the vertical edges with the side walls, provision is made that the vertical edges extend up to the lateral boundaries in the closed state of the cupboard, and the rotation shaft or rotary column is inwardly translatable from the closed position along the diagonal of the corner to allow the side edges to remain within the lateral boundaries during rotation. In this case the rotation shaft is hollow and a synchronization shaft extends therethrough, the synchronization shaft being in engagement both at the top and the bottom in guides which extend along the diagonal of the corner and are fixed to the floor or the cover plate, in the manner of a rack-and-pinion connection. In this manner a collision of the vertical edges of the front panels of the front element with the side walls of the housing of the corner cupboard is indeed avoided, but for this purpose, the side walls of the housing must be cut out in the region of their front half. Moreover, the rack-and-pinion connections are very expensive to manufacture. Furthermore, the rotation shaft must be guided on the housing both at its bottom and at its upper ends.

A further drawback of the known kitchen corner cupboard resides in the fact that the cam tracks which ensure the diagonal displacement must be shaped very abruptly so that a comparatively high linear diagonal displacement can be initiated even by very small rotary displacements, which requires comparatively high rotation forces and leads to an increased wear of the cam tracks. In addition, a certain degree of rotation is a precondition for the diagonal displacement, such that corresponding slits must be left along the vertical edges of the front element.

SUMMARY OF THE INVENTION

The object of the present invention is to provide a corner cupboard, in particular a kitchen corner cupboard, of the kind mentioned at the beginning, in which the rotation shaft need not be journalled or guided at the top, so that it does not need to project upwardly above the uppermost carrier plate and a reception space uninterrupted by the rotation shaft is achieved in this area, and in which the diagonal displacement necessary for liberating the vertical edges of the front panels of the front element is possible independently of a rotary movement of the carousel.

This problem is solved by the rotary and the diagonally displaceable mounting of the rotation shaft exclusively at its lower end. The rotation shaft terminates therefore at its upper end at the height of the uppermost carrier plate, such that a free reception space uninterrupted by the rotation shaft is at disposal between the uppermost carrier plate and the cover plate of the corner cupboard housing placed thereabove. Since the diagonal displacement body is displaceable linearly diagonally independently of a rotation movement of the rotation shaft, and indeed preferably in a manner locked against rotation, the slit between the vertical edges of the front panels of the front element and of the front panels of the adjacent cupboards can therefore be kept extremely narrow. It is only necessary that the side walls of the housing be each provided at their forward ends with a chamfer which extends parallel to the diagonal and allows the diagonal displacement of the vertical edges along the chamfers.

The idea of the invention thus resides in that a particular component is provided in the lower region of the housing for the diagonal displacement, the vertical rotation shaft being rotatably journalled in a suitable manner on this component. Thereby all diagonal translation displacements and rotation displacements can be controlled largely independently of each other in the manner necessary for the ideal occupation of space.

In the preferred embodiment only a diagonal translation of the carousel is possible from the closed rotary position, and with the exception of the rearmost displaced position, a rotation of the carousel is not possible. The rotary movement of the carousel is released only when the vertical edges of the front element have come free away enough from the side walls of the housing such that during the following rotation a collision of the vertical edges with the side walls is no longer possible.

This can in particular be achieved by the fact that a blocking pin mounted at a fixed place on the base body of the housing, preferably on the side of the rotation shaft facing the front element, engages in a suitable transverse bore in the rotation shaft and restrains the latter against rotation, if the carousel is not in the position ready for rotation or a rotated position. Starting from the position ready for rotation the transverse bore is progressively displaced over the blocking pin by translation of the carousel towards the closed position, either immediately or just after a very small translation, whereby a rotation of the carousel is prevented in all corresponding intermediate positions and in the closed position, and otherwise a rotation of the carousel is possible when the transverse bore is fully displaced away from the blocking pin.

In order to make it possible to attain easily and exactly the position ready for rotation from any rotary position of the carousel for thereafter closing the corner cupboard, a latch device as provided. This latch device comprises preferably a finger fixed to the rotation shaft and therefore rotating therewith, the finger being provided with a depression or a groove, in which the ball of a ball snap mounted on the diagonal translation body catches in the closed rotary position of the carousel and thereby defines this position.

Since the distance of the diagonal translation of the carousel towards the interior is only limited by the diameter of the circular carrier plates used, the diagonal translation of the carousel can extend without restriction, by corresponding dimensioning of the carrier plates, as long as during the subsequent rotation a collision of the vertical edges with the side walls of the housing, which are not cut out, is avoided.

According to the invention the inward translation of the carousel on the translation body is thus limited to a value, preferably by means of an abutment, for which during the subsequent rotation displacement the vertical edges of the front element do not collide with the side walls of the housing.

Basically, a compulsory rotation guidance for the carousel could be provided after the diagonal translation has occurred until the abutment, such that the carousel is then compulsorily guided on a circular track, until a 360° rotation is achieved, whereafter the carousel can then again be translated diagonally outwardly to the closed position.

However, the vertical edges of the front element must then project radially from the rotation shaft somewhat further than the carrier plates, and preferably by about 10–15% further, such that if during the diagonal translation the carrier plates arrive in the region of the rear wall of the housing and for a rotation of the carousel of about 90° the vertical edges of the front element could collide against the rear wall of the housing, and indeed in particular when the diagonal translation range of the diagonal translation body limited by the diameter of the carrier plates is reduced to zero.

Another important aspect of the invention resides in that firstly the diagonal translation path of the translation body limited by the circular carrier plates is entirely reduced to zero in such a manner that the periphery of the carrier plate comes as close as possible to the rear wall of the housing, which is preferably correspondingly curved. In this case a nonrestrained and friction-free rotation of the carousel is still possible.

As soon as the first of the two vertical edges comes so close to the rear wall, after a rotation of for example about 90°, that a collision can occur, the translation body is displaced again in opposite direction toward the front, together with the rotation shaft, by means of a corresponding cam-and-cam track guide, to avoid a collision of the vertical edges with the rear wall. In other words, the carousel is thus again slidably displaced forwardly, and this forward translation is limited by the diameter of the carrier plates, which should thereby come closer to the side walls of the housing to only such an extent that a non-restricted and friction free rotatability is still possible. Since however, for reasons of construction, the diameter of the carrier plates can only be so large that they do not come into contact with the side walls of the housing when the rotation shaft is in the closed position, the rotation shaft can practically be returned again to its forward starting position after a rotation of for example 90° to one or the other side. This brings not only the advantage that the vertical edges projecting further radially can be moved past the curved rear wall of the housing without risk of collision, but also that the carrier plates also take their foremost position, such that they provide the best accessibility for the user.

When further rotating the carousel over an angle of for example 270°, there occurs again a rearward translation of the rotation shaft, such that a collision of the vertical edges with the other side wall of the housing is also avoided during this portion of the rotation movement. This retracted position of the rotation shaft remains until the closed rotary position is reached, whereafter the carousel can be then displaced again forwardly in the closed position, together with the front element.

The preferred embodiment of the invention consists thus in that the rearwardly diagonally displaced position of the carousel is held only as long as it is necessary for the vertical edges to go past the side walls of the housing, whereas in all other angular positions of the carousel the rotation shaft generally occupies the most forwardly displaced diagonal position.

The further displacement of the carousel in the closed rotary position in forward direction and preferably also in the rearward direction is determined by abutments.

In a particularly preferred constructional embodiment, the entire translation mechanism is covered below the base plate and thereby safely arranged against soiling. From above, only the elongated hole with the upwardly projecting rotation shaft are apparent. A risk of hurting the user by the translation mechanism is also thereby safely excluded. The forward end and preferably also the rear end of the elongated hole form the abutments.

The diagonal guides can preferably be formed by linearly displaceable bearings arranged at the four corners of a rectangle or of a square, diagonally translatable translation rods being engaged in these bearings, and the diagonal translation plate is in turn fixed to the translation rods, for example by welding.

In order to ensure a sufficient stability of the carrier plates against tilting, there is provided in particular a carrier spigot. Although fundamentally the free diagonal translatability in the closed rotary position could alone be sufficient, it is nevertheless preferred to provide the compulsory guidance features guides a cam body.

For the constructional realization of these compulsory guides, the cam body according to the preferred is particularly advantageous.

The several forward and rearward translations within a 360° rotation are carried out in a particularly advantageous manner.

Another feature of the invention provides dimensions which are particularly advantageous.

By means of the arrangement of the front panels, one can attain that the front element is adjusted particularly well and suitably in the cornered intermediate space between two adjacent cupboard elements.

BRIEF DESCRIPTION OF THE DRAWINGS

The invention will now be described by way of example and with reference to the drawings; in these drawings.

DESCRIPTION OF THE PREFERRED EMBODIMENTS

Figure 1:
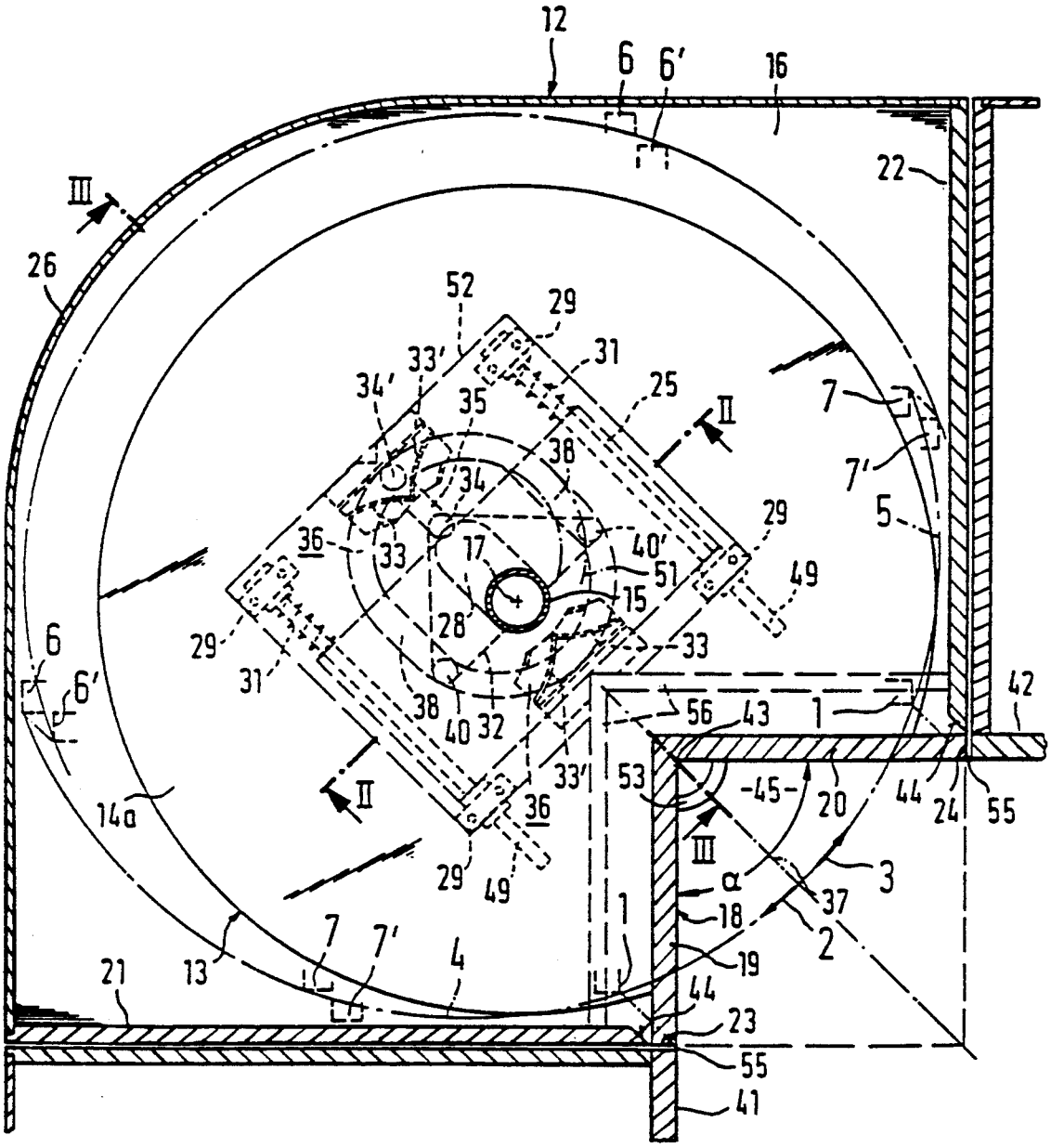
FIG. 1 is a partly cutout schematic plan view of a kitchen corner cupboard according to the invention.

According to FIGS. 1 to 3, the kitchen corner cupboard of the invention comprises a housing 12 having two side walls 21, 22 arranged at an angle of 90° and defining an opening 45 between their front edges, as well as a curved rear wall 26, a cover plate 11, a base plate 16 spaced from the floor 27, and a carousel 13 rotatable about a vertical axis 17, the structure of the carousel being described in detail hereinafter.

The carousel 13 comprises a front element or cornered front 18 which occupies the opening 45 in the closed rotary position, the front element comprising two front panels 19, 20 arranged at a mutual angle α of 90°, one panel 19 extending parallel to the side wall 22 and the other panel 20 extending parallel to the side wall 21. The corner 43 of the cornered front 18 is located in the closed rotary position on the diagonal 37 which is produced when one imagines that the mutually perpendicular extending side walls 21, 22 of the housing 12 are completed to form a rectangle. In this embodiment, the corner 43 coincides with the intersection line of the imaginary extensions of the front elements 41, 42 of adjacent cupboard housings and is located, like this intersection line, at a clear spacing in front of the axis of rotation 17.

The cornered front 18 which forms the closure of the kitchen corner cupboard of the invention is fixed in corresponding right angled cutouts of the horizontal carrier plates 14*a*, 14*b* by means of appropriate fittings 46. The carrier plates 14*a*, 14*b* have a circular shape, with the exception of the right angled cutouts for the reception of the cornered front 18, and are mounted with a vertical spacing on a vertically extending rotation shaft or column 15. The vertical rotation shaft 15 extends only downwardly and not upwardly from the uppermost horizontal carrier plate 14*b*, such that a continuous reception space 47 uninterrupted by the rotation shaft 15 is defined above the uppermost carrier plate 14*b*.

The rotation shaft 15 rests on a vertical carrier spigot 30 so that it is rotatable about a vertical axis 17. The spigot 30 is fixed to a horizontally disposed diagonal translation plate 25 arranged below the base plate 16 and extends upwardly through a diagonally disposed elongated hole 28 of the base plate 16 until slightly above the lower carrier plate 14*a*. In turn, the rotation shaft 15 which is arranged radially outwardly of the carrier spigot 30 also extends through the diagonal elongated hole 28 up to a point slightly above the diagonal translation plate 25, where the rotation shaft 15 is also conveniently supported directly on the diagonal translation plate 25 by means of an axial support bearing 48. According to FIGS. 1 to 3, the diagonal translation plate 25 is rectangularly shaped, the short sides extending parallel to the diagonal 37. Carrying and guiding rods are attached, e.g. welded, to the diagonal translation plate parallel to the short sides, the guiding rod extending on either side of the diagonal translation plate 25 a significant distance beyond its long sides. The two end regions of each rod 49 extending beyond the long sides of the diagonal translation plate 25 are diagonally displaceable mounted in diagonal guide blocks 29. The displacement movement is limited by the ends of the diagonal elongated hole 28.

Relatively weak return springs 31 can be provided between the rear bearing blocks 29 and the diagonal translation plate 25, in order to bias the rotation shaft 15 against the front border of the elongated hole 28.

The bearing blocks 29 are fixed to the base plate 16 from below by means of appropriate fittings 50.

Owing to the described arrangement, the carousel can be translated diagonally within the diagonal elongated hole 28 together with the components which are fixed to the carousel 13, whereby the vertical edges 23, 24 of front panels 19, 20 of the cornered front 18 can be translated inwardly from the closed rotary position apparent in FIG. 1 inwardly until the position 1 indicated in broken lines, along corresponding chamfers 44 of the front edges of the side walls 21, 22. By the subsequent rotational movement in one direction 2 or the other 3, the vertical edges 23 or 24 reach the closest distance from the side walls 21, 22 at 4 or 5, without colliding with the side walls 21, 22 because the diagonal translation of the rotation shaft 15 until the rear end of the diagonal elongated hole 28 has been effected before the rotational movement in the direction of the arrow 2 or 3.

The carousel 13 could then basically be rotated up to an angle of 360° starting from the closed rotary position, if the rear wall 26 was at a sufficiently great distance from the carousel 13. However, with ideal use of the concept of the invention, the rear wall 26 is only spaced from the rotation axis 17 by a distance such that when further rotating the carousel and the vertical edges 23, 24 have finally reached the positions indicated by 6 or 7, where a collision of the vertical edge 23 (6) with the rear wall 26 could directly occur, a return forward translation of the rotation shaft 15 within the diagonal elongated hole 28 takes, place shortly before arriving at this position. Thus the vertical edges 23, 24 in fact adopt the positions 6', or 7' respectively. The same occurs—as also indicated by 6, 6', or 7, 7' respectively—when the carousel is rotated in the direction of the arrow 3 starting from the closed rotary position.

After the vertical edges 23, 24 have come to the positions 6', 7', in which the rotation shaft 15 has been translated forwardly in the diagonal elongated hole 28, a further rotation of the carousel can now occur, during which the vertical edges 23, 24 move along the rear wall 26 between the two illustrated positions 6, 6', without coming into contact with the rear wall. By this the carrier plates 14*a*, 14*b* reach their foremost position, such that the objects placed on the carrier plate are ideally accessible.

As soon as the vertical edges 23, 24 have again reached the positions 6', 7', after a rotation in the range of about 270°, the rotation shaft is again steadily rearwardly translated within the elongated hole 28, until the vertical edges 23, 24 come again to the positions 6, 7. Then the further rotation can take place until the closed position, without a collision with the side walls 21 or 22 occurring.

Although it is basically possible to manually control this sequence of movements, it is however preferred when this sequence of movements occurs largely in a compulsorily guided or constrained manner.

To that effect, a cam plate 32 is mounted on the rotation shaft below the base plate 16 but above the diagonal translation plate 25, the cam plate 32 having generally the triangular shape shown in FIG. 1. At a distance behind the rotation shaft 15 the cam plate 32 comprises an upwardly directed main cam 34 which is received in the closed rotary position within a diagonal compulsory guide track 35 formed in a guide plate 52, which is fixed to the base plate 16 from below. In this manner the carousel 13 can be displaced starting from the closed condition illustrated in FIG. 1 at first only in direction of the diagonal 37 until the main cam 34 reaches the position ready for rotation indicated at 34' in FIG. 1, in which the rotation shaft 15 has reached the rear end of the diagonal elongated hole 28. The main cam 34 is now located within a circular compulsory guide track 36 provided in the plate 52 which only permits a rotational movement of the rotation shaft to both sides up to an angle of about 90° about the fully rearwardly translated vertical axis 17. Basically, this circular compulsory guide track 36 could extend over an angle of 360°, as indicated in dash and dot lines 51', in order to compel the carousel 13 to execute a corresponding rotational movement until its return to the position in which it is ready to rotate. This would however only be possible if the rear wall 26 was placed at a somewhat larger distance from the rotation axis 17 as illustrated in FIG. 1, or if the carousel 13 with the cornered front 18 had a somewhat lower diameter as in FIG. 1, which could in practice occur by a certain off-set of the rotation axis 17 and of the elongated hole 28 in the direction of the cornered front 18. However, in order to ideally use the available space, the front and rear halves of the circular compulsory guide track 36 are interrupted by linear guide sections 38 which extend parallel to the diagonal 37 and allow a return translation of the rotation shaft 15 over those angular ranges where the vertical edges 23, 24 are in the region of the rear wall 26.

In order to now stabilize the guidance of the rotation shaft 15 also in those regions where it takes place parallel to the diagonal 37 and to control the diagonal to and fro movement of the rotation shaft 15, auxiliary auxiliary guide tracks 33, 33' are provided in front of or behind the ends of the diagonal elongated hole 28, and cooperate with auxiliary cams 40, 40' of the cam plate 32 which are angularly displaced by 90° with respect to the vertical axis 17. The cams 34, 40, 40' are all placed in different planes. The compulsory guide tracks 35, 36 are in the same plane, whereas the tracks 33, 33' are placed in different planes both with respect to each other and with respect to the tracks 35, 36.

Figure 2:
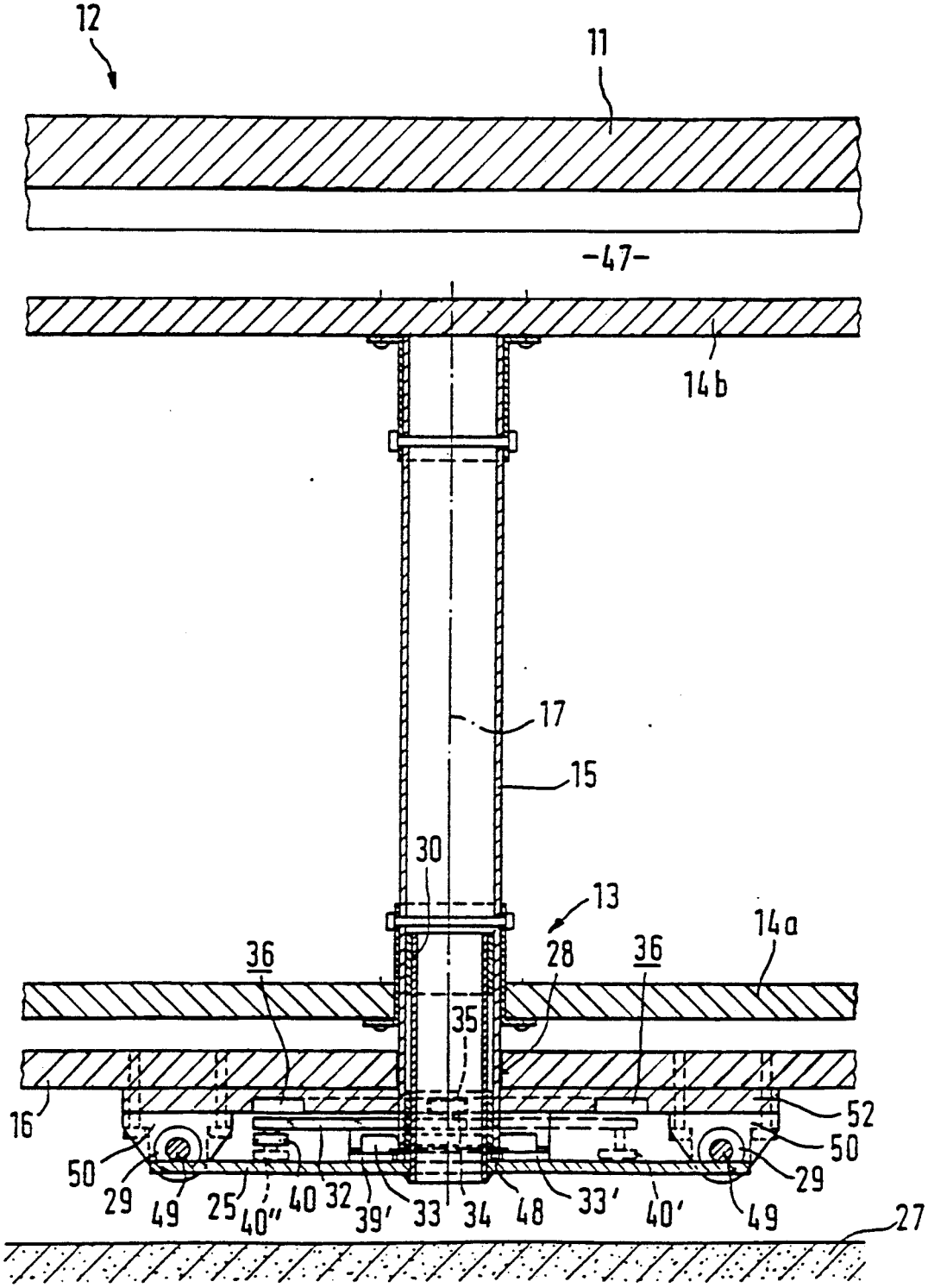
FIG. 2 is a schematic cross-section along line II—II of FIG. 1.
Figure 3:
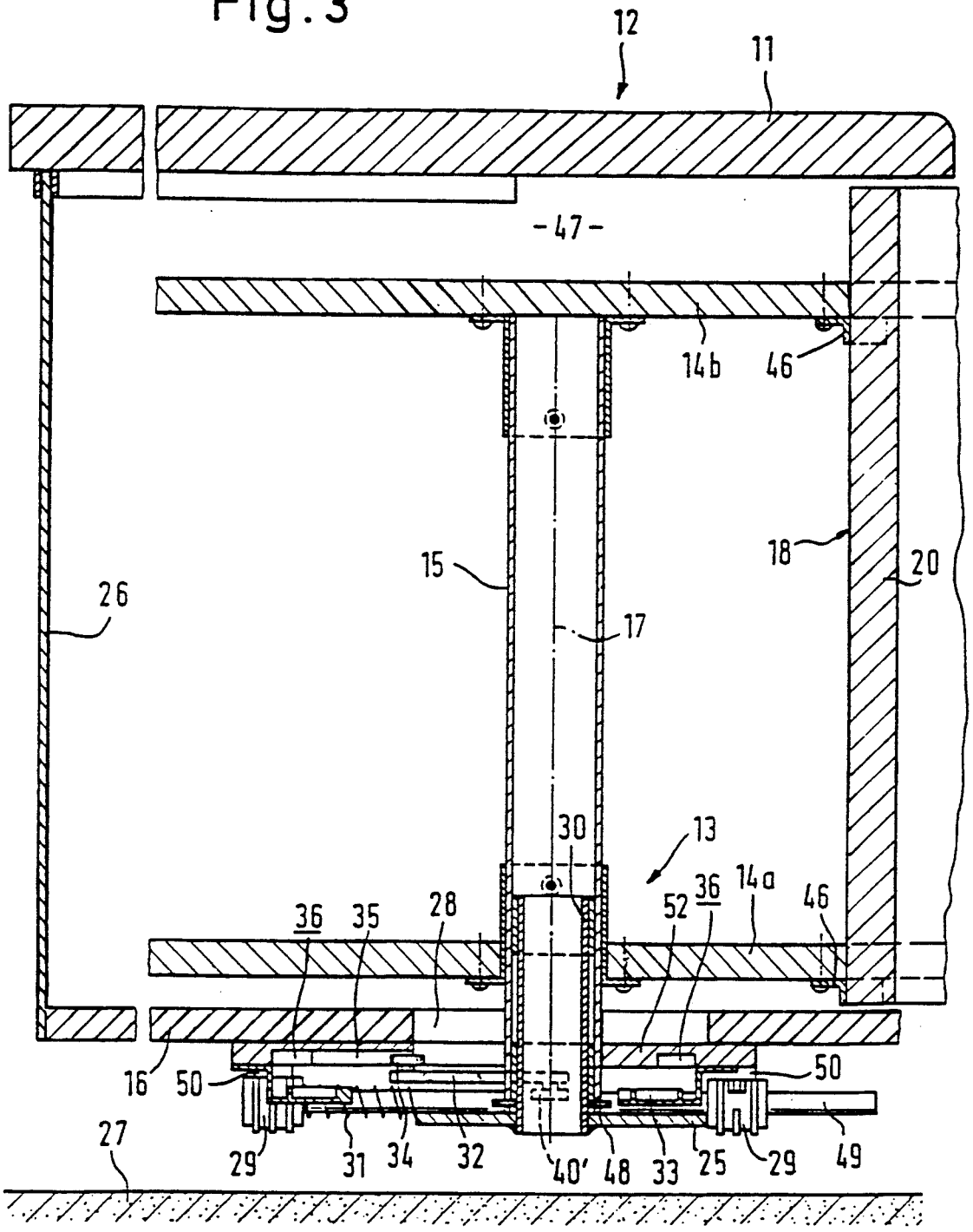
FIG. 3 is a schematic cross-section along line III—III of FIG. 1.

The arrangement described operates as follows:

Starting from the closed position illustrated in FIGS. 1 to 3, the carousel is firstly displaced by exerting a diagonal pressure on the cornered front 18 until the rotation shaft 15 reaches the rear end of the diagonal elongated hole 18. The carousel can then be rotated in one direction or the other. During about the first 40° to 50° of the rotational movement, the circular compulsory guide track 36 compels the carousel to execute a circular movement.

After a rotation angle of about 40° to 50° in one direction or the other either the auxiliary cam 40 reaches the auxiliary compulsory guide track 33 or the auxiliary cam 40' reaches the auxiliary compulsory guide track 33' behind the elongated hole 28. Owing to the curved shape of these auxiliary compulsory guide tracks 33, 33' apparent from FIG. 1, the rotation shaft 15 is again forwardly translated within a comparatively small rotation angle of about 30°, such that the vertical edges 23, 24 reach the positions 6', 7' instead of the positions 6, 7 which they would reach without the auxiliary compulsory guide tracks 33, 33'. During this displacement the guidance of the rotation shaft 15 is ensured exclusively by the auxiliary cam 40 or 40', whereas the main cam 34 is received with sufficient play within one of the straight sections 38.

As soon as the positions 6', 7' have been reached, the main cam 34 enters the lower half of the circular compulsory guide track 36, whereby the rotation shaft 15, which has now reached its forward position, is rotated over an angle of about 130° to 140°. Hereafter either the auxiliary cam 40 or the auxiliary cam 40' enters to the associated front auxiliary compulsory guide track 33 or 33' and initiates the return translation of the rotation shaft 15 towards the rear position, and the main cam 34 is again received with sufficient play in one of the straight sections 38.

After the rotation shaft 15 has been again translated to the rear position, which corresponds approximately to the positions 6, 7 of the vertical edges 23, 24, the last portion of the rotation movement can take place until 360° are reached. Here the main cam 34 ensures again the compulsory guidance until the position ready for rotation 34' is reached. The carousel 13 can now be again moved diagonally forwardly into the closed position shown in FIG. 1 either by the action of the weak springs 31 and/or by pulling a handle 53.

Figure 4:
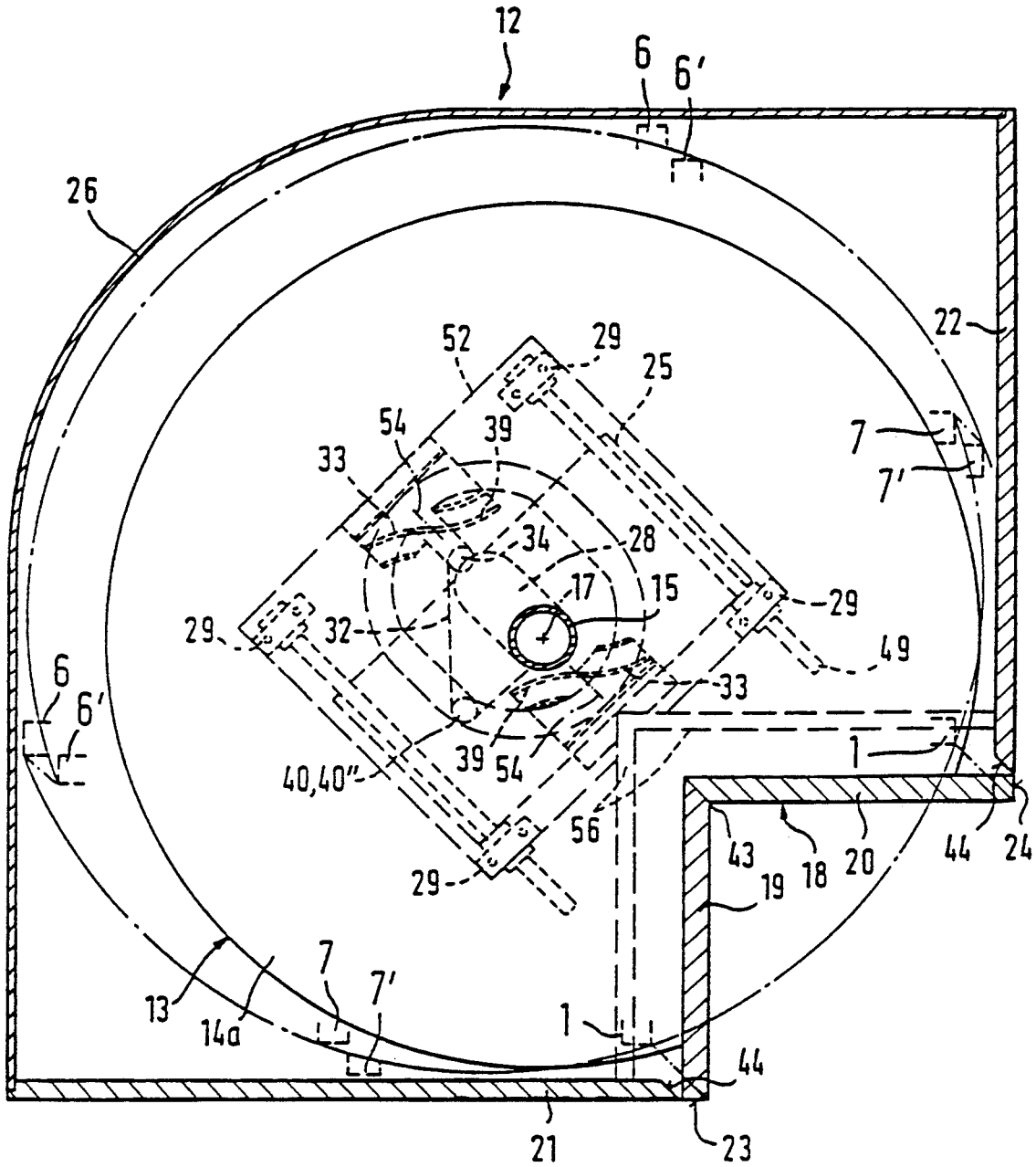
FIG. 4 is a partly cutout schematic plane view similar to FIG. 1 of a further embodiment of the compulsory guidance.

In accordance with FIG. 4, in which the same reference numerals designate corresponding parts to those of FIGS. 1 to 3, one can use auxiliary cams 40, 40'' arranged above each other and also placed in different planes, instead of using auxiliary cams 40, 40' (FIG. 2) symmetrical to each other. The two embodiments are indicated in FIG. 2, but can be used only alternatively.

While the upper cam 40 cooperates with the auxiliary compulsory guide track 33 in the same manner as in the embodiment of FIGS. 1 to 3, the lower cam 40'' cooperates with an auxiliary compulsory guide track 39, which is shaped exactly inversely with respect to the track 33' of FIG. 1, whereby the same type of compulsory guidance is achieved as in FIG. 1 owing to the inverted arrangement of the second auxiliary cam 42 with respect to FIG. 1. Attention is to be paid again that the auxiliary compulsory guide tracks 33, 39 are placed in different vertically off-set planes corresponding to the planes of the auxiliary cams 40, 40''. The boundary line at either side of which the different auxiliary forced guide tracks 33, 39 are formed is indicated in FIG. 4 by the reference 54.

In the closed position illustrated in FIG. 1, the front panels 19, 20 of the cornered front 18 are flush with the front panels 41 or 42 of adjacent cupboard elements. The slit 55 between the vertical edges 23, 24 of the front panels 19, 20 and the opposite vertical edges of the front panels 41, 42 can be selected extremely narrow.

The chamfers 44 of the side walls 21, 22 at the front end are so selected that when translating the cornered front 18 rearwardly in the direction of the diagonal 37, the vertical edges 23, 24 can move along the front edges of the side walls 21, 22 without collision.

The maximum diagonal translation path of the rotation shaft 15 is about 60 mm.

As indicated in FIGS. 1 and 4 by the reference 56, the base plate 16 is cut-out in correspondence to the cornered front or in general to the front element 18, while a pedestal which also has a shape corresponding to that of the cornered front 18, in this case a right angled shape, is placed below the base plate. This right angled pedestal is placed approximately where the cornered front 18 is placed in the rearwardly translated position in the diagonal elongated hole 28 (position 1 indicated in broken lines in FIG. 1).

Figure 5:
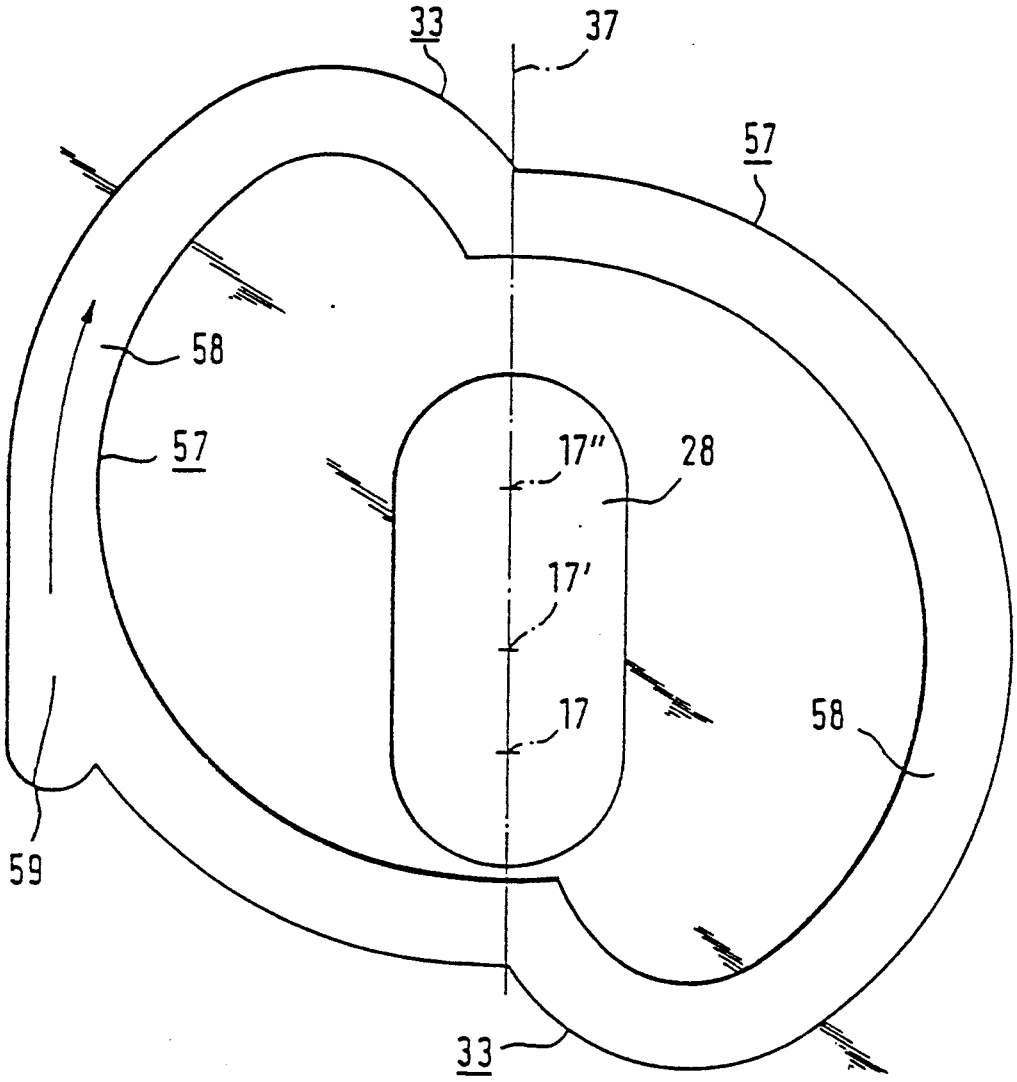
FIGS. 5 and 6 are schematic partial plane views of a further simplified embodiment.

A particularly preferred embodiment of an auxiliary compulsory guide track arrangement 57 is shown in FIG. 5. The tracks 33 correspond to those of FIG. 1. Continuous junction circular guide regions 58 are however located between the tracks 33, and in this embodiment these circular guide regions 58 receive the sole auxiliary cam 40 which is provided in addition to the main cam 34, when the main cam 34 circulates along the circular regions 36 (FIG. 1). The position of the rotation axis 17 in the rearmost position is indicated by 17'', the position at which the rotation axis 17 is placed when the rotation shaft 15 is translated again forwardly as the vertical edges 23 or 24 come closer to the rear wall 26 is indicated by 17'. It is thus not necessary that this translation takes place fully into the foremost position 17.

A straight guide track 59 extending forwardly and parallel to the diagonal 37 branches off from the left circular region 57 and linearly guides the auxiliary cam 40 in the position of FIG. 1. In this manner the desired sequence of displacement occurs by translation and rotation in the direction of the arrow. When the rotation takes place in the opposite direction, the return translation occurs angularly somewhat later, which can be however taken into account by an appropriate selection of the diameter of the carousel 13. For this, one can get away with one auxiliary cam 40 and a closed guide track 57.

Figure 6:
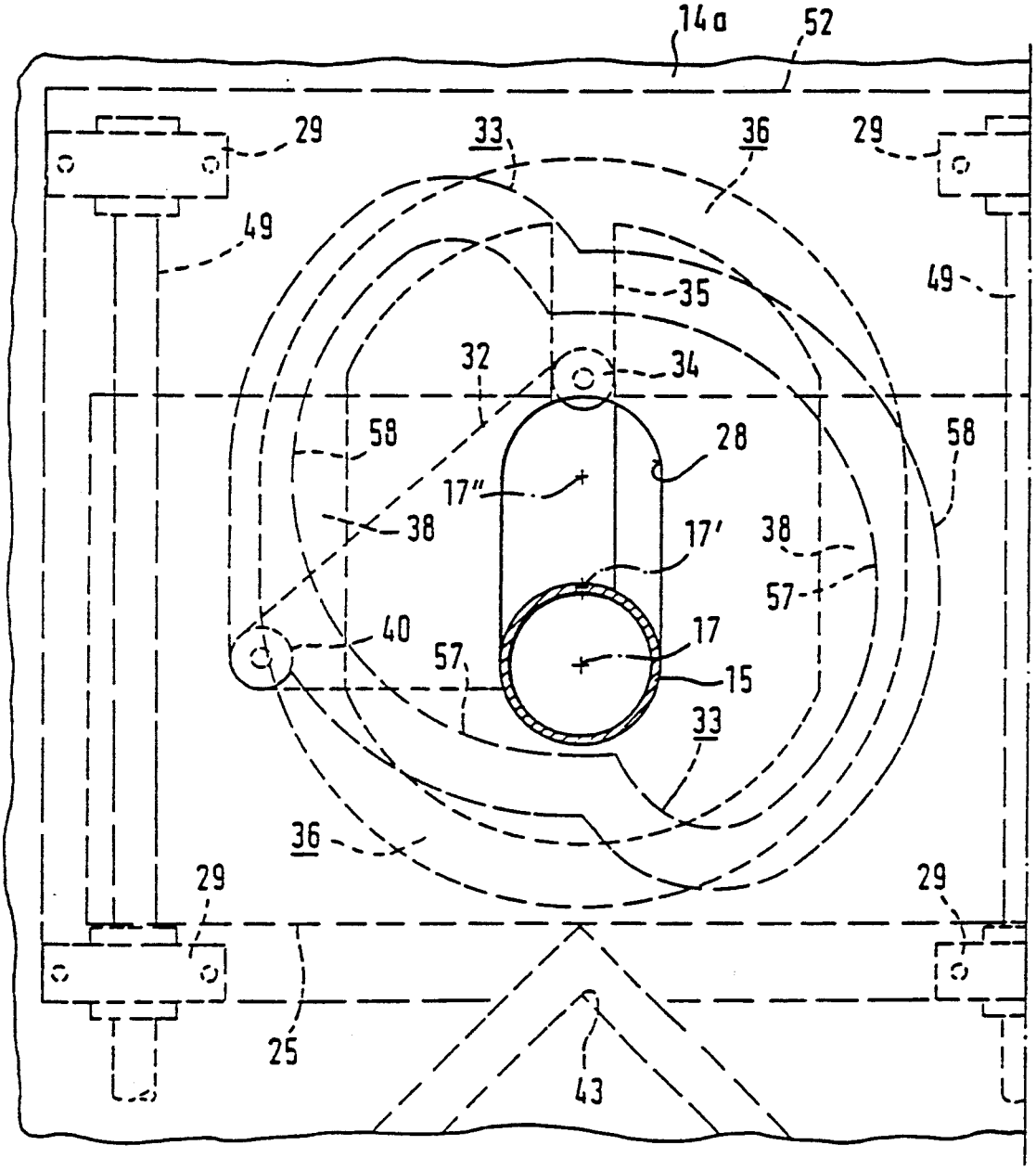

FIG. 6 shows schematically the relationships between the guide track 57 and the tracks 35, 36, 38 and the cams 34, 40.

Figure 7:
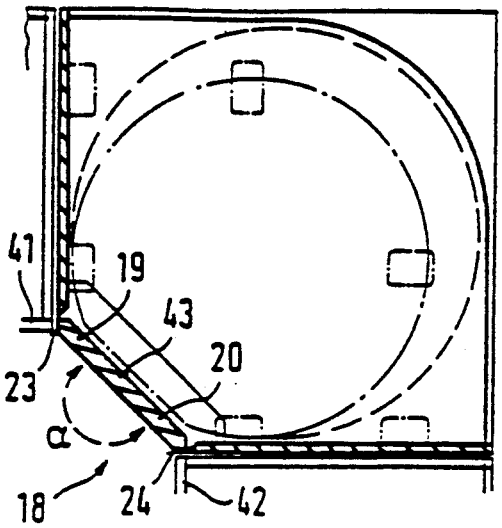
FIGS. 7 and 8 are schematic representations of further embodiments of the front element of the kitchen corner cupboard.

As shown in FIG. 7, the front panels 19, 20 can also form an angle $\alpha$ of 180° and form thus a plane front element 18, whereby a particularly high usable surface of the carrier plates 15*a* and 15*b* is achieved. This surface is then located at an obtuse angle, of about 135° in the shown example, with respect to the front panels 41 and 42 of the adjacent cupboard elements. The vertical connection center line 43 of the front panels 19, 20 lies therefore in the same plane as their vertical edges 23 and 24. The front panels can thus be realized in piece in the form of a plate. In the closed condition of the carousel 13 each of the vertical edges 23 and 24 further lay in the plane of one of the front panels 41 or 42 of the adjacent cupboard elements; in other words they adjoin the latter while suitably leaving a small distance for a sufficient freedom of movement.

Figure 8:
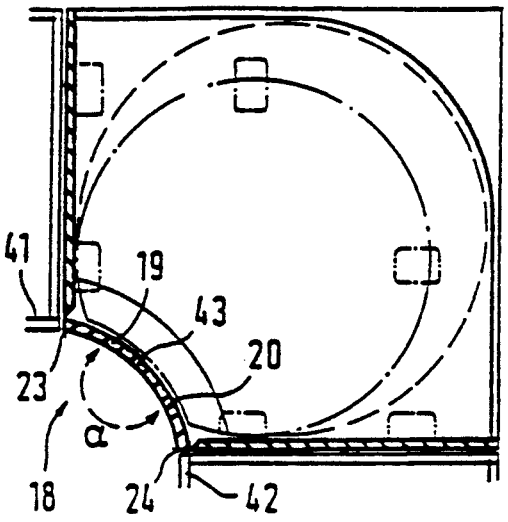

The front panels 19, 20 can also be curved as shown in FIG. 8 and form a curved front element 18 which makes a transition between the planes of the front panels 41 and 42 of the adjacent cupboard elements, such that the vertical edges 23 and 24 of the front panels 19 and 20 of the corner cupboard comes flush with a respective front panel 41 or 42 respectively. The front element 18 has therefore a concave cylindrical curved shape which matches to certain styles of furniture. The front panels 18, 19 adjoin in this case under an angle $\alpha$ of 180° at the vertical connection center line 43.

Figure 9:
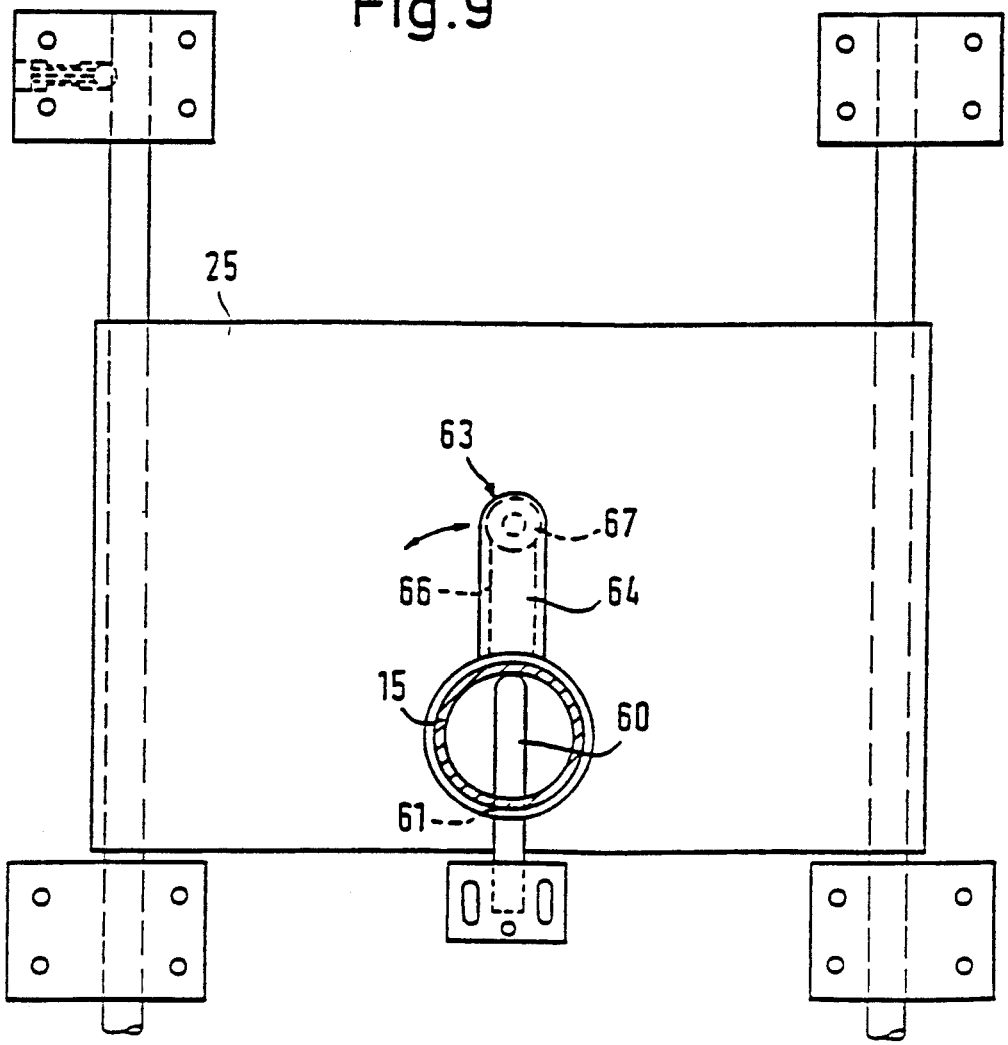
FIG. 9 is a schematic plane view of a rotation lock and of a latching device.
Figure 10:
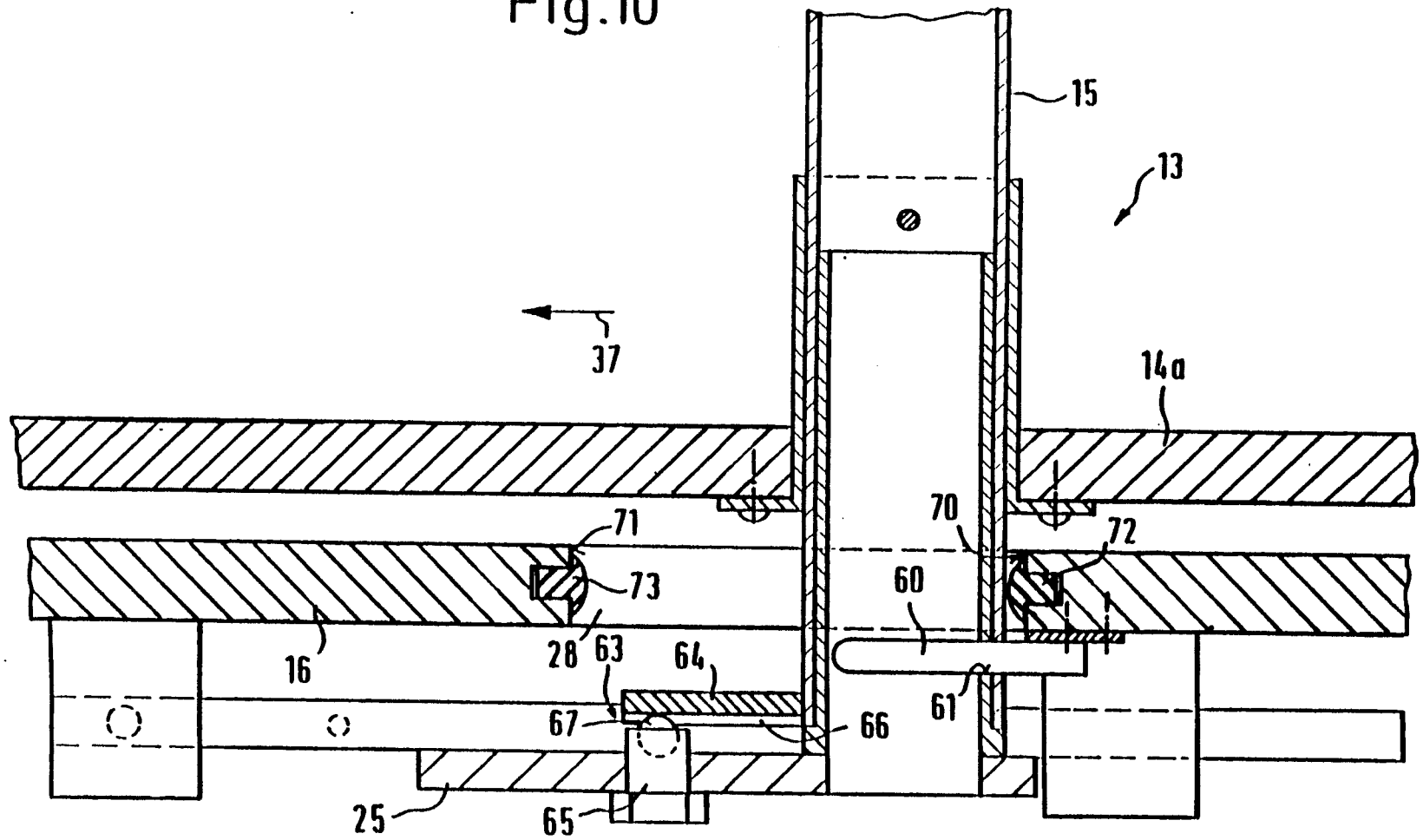
FIG. 10 is a schematic side view of the rotation lock and the latching device of FIG. 9.

FIGS. 9 and 10 show a rotation lock and a latching device for the rotation shaft 15. The rotation lock comprises a blocking pin 60 mounted at a fixed place on the base body 16 and extending in the diagonal direction 37. The blocking pin is positioned in such a manner that it engages into a transverse bore 61 in the rotation shaft 16 when the latter is not in the position ready for rotation or close to this position, or in any desired rotary position. In the closed position of the rotation shaft 15 illustrated in FIGS. 9 and 10 the transverse bore 61 is engaged to the greatest extent over the locking pin 60. On translation of the rotation shaft 15, or of the carousel 13 from the closed position into the position ready for rotation, the transverse bore 61 is also translated with respect to the blocking pin 60, Which is equivalent to an extraction of the latter out of the transverse bore 61. When the position ready for rotation is reached, or eventually shortly before this, the blocking pin 60 is fully extracted out of the bore 61 and the carousel 13 or the rotation shaft 15 can then be freely rotated, in order to allow a corresponding displacement of the rotation shaft 15 by cam control of the latter.

In order to simply and precisely set the position ready for rotation from any desired rotary positions of the carousel 13, there is provided a latch device 63. The latter comprises a transversely projecting finger 64 which is attached to the rotation shaft 15 in the vicinity of the diagonal translation plate 25 and can be rigidly rotated together with the rotation shaft 15. The finger 64 is provided at its underside and in a longitudinal direction with a groove 66 into which the ball 67 of a ball snap 65 engages when the carousel 13 occupies the closed rotary position. The ball snap 65 represents a key and is mounted at a corresponding position on the diagonal translation plate 25.

If the carousel 13 is in any rotation position and is to be brought into the position ready for rotation, it need only be rotated until the ball 67 of the ball snap 65 engages the groove 66 of the finger 64. The rotation shaft 15 then occupies the closed rotary position or position ready for rotation and the carousel 13 can be displaced to the closed condition, while the simultaneously aligned transverse bore 61 can be engaged in a problem-free manner over the blocking pin 60 and prevents a rotation of the carousel 13 during the translation into the closed condition and when in the latter.

The groove 66 can be made in the finger 64 in a particularly simple manner and permits a certain compensation of manufacturing tolerances. Instead of the groove 66 a depression having another shape can also be provided in the finger 64, such as for example a detent into which the ball 67 can engage.

As it can further be seen from FIG. 10, rubber pads 72 and 73 are provided as abutments at the ends 70 and 71 of the diagonal elongated hole 28 in order to limit the diagonal translation path of the rotation shaft 15. This can also be achieved by additional or alternative stops directly for the diagonal translation plate 25.

What is claimed is:

1. Kitchen corner cupboard comprising a housing (12) having an upper cover plate (11), a base, and a carousel (13) mounted in the housing, the carousel having a vertical rotation shaft (15) onto which are mounted at least one horizontal carrier plate (14*a*, 14*b*), which is substantially concentric to the rotation shaft (15), a front element (18) defined by first and second, angularly inclined front panels (19, 20), the rotation shaft (15) being located at a substantial distance behind an intersecting line of imaginary extensions of angularly inclined front panel boards (41, 42) of the housing, the rotation shaft (15) being rotatably journalled at its lower end region about a vertical axis (17) in the base, means including a translation body for displacing the rotation shaft in a diagonal direction between a first, closed rotary position in which sides of the front element (18) adjoins the front panel boards (41, 42), and a second position ready for rotation, in which the carousel (13) can be freely rotated without contact between vertical edges (23, 24) of the front element (18) and the housing (12), the diagonal translation body (25) including means for rotatably mounting the rotation shaft (15) thereto, means for moving the translation body (25) relative to the base to and fro in a diagonal direction (37) between the first position and the second position ready for rotation, and means operatively coupled with the translation body and the rotation shaft (15) permitting rotation of the rotation shaft only when it is in the position ready for rotation and locking the rotation shaft against rotation when in any other position.

2. A kitchen corner cupboard according to claim 1 wherein the front member (18) is defined by first and second, concavely cylindrical, curved front panels (19, 20) connected to each other to form a unitary piece, the front panels forming a curved front element, and wherein a vertical connection center line (43) of the front element is forwardly offset from the intersection line in the closed position.

3. A kitchen corner cupboard according to claim 1 wherein the lower end region of the rotation shaft is rotatably journalled, and wherein the rotation shaft has a free, nonjournalled upper end region.

4. Kitchen cupboard according to claim 3 including a latch device (63) as a positioning aid for latching in the closed rotary position, the latch device (63) comprising a finger (64) fixed to the rotation shaft (15) and extending transversely thereto and a feeler member (65) arranged on the translation body (25), the feeler member being latched with the finger (64) in the closed rotary position of the rotation shaft (15), and the feeler member defining a ball snap (65) having a ball (67) engaging a depression (66) of the finger (64) in the closed rotary position of the rotation shaft (15).

5. Kitchen corner cupboard according to claim 3 including means for displacing the rotation shaft when the vertical edges (23, 24), during rotation from the position ready for rotation, have passed a nearest position with respect to the side wall (21 or 22) first encountered in the direction of rotation, such that the carrier plates (14*a*, 14*b*) are displaced towards the front panel boards in the diagonal direction (37) and the vertical edges (23 or 24), when located adjacent a rear wall (26) of the housing, are spaced from the rear wall (26); the translation body (25) being mounted below the base plate (16) and the base plate being arranged at a distance from the floor (27); the base plate including a diagonal elongated hole (28) defining the diagonal translation path of the rotation shaft (15) and the rotation shaft (15) extending through the diagonal elongated hole; the translation body being a translation plate (25), and diagonal guides (29) on both sides of the rotation shaft (15) controlling movement of the translation plate in the diagonal direction; a central vertical carrier spigot (30) attached to the base plate (16), the carrier spigot (30) defining a vertical tube for rotatably mounting the rotation shaft (15).

6. Kitchen corner cupboard according to claim 3 including means for moving the rotation shaft (15) as a result of rotational movements of the rotation shaft in the diagonal direction from the closed rotary position and, over those ranges of angular rotation in which the vertical edges (23, 24) come the closest to walls (21, 22, 26) of the housing (12), so that the vertical edges (23, 24) are positioned at a predetermined safety distance from the walls (21, 22, 26) of the housing in each rotational position of the rotation shaft, the rotation shaft (15) being freely translatable out of the closed rotary position and being compulsorily diagonally guided between the closed position and a position ready for rotation.

7. Kitchen corner cupboard according to claim 3 including a cam plate fixed to the rotation shaft (15) below the base plate (16), the cam member cooperating with cam-guides (33, 35, 36, 51) fixed to the base plate (16), the cam plate (32) carrying a main cam (34) at a diagonal distance behind the rotation shaft (15), the main cam (34) being received in the closed rotary position in a diagonal compulsory guidance track (34) having a rear end opening symmetrically into a circular compulsory guidance track (36), the main cam (34) running in a circular compulsory guidance track (51) at the end of the diagonal compulsory guidance track (35), the circular compulsory guidance track (36) being joined at both ends by two straight sections (38) extending parallel to the diagonal direction (37), the length of the straight sections (38) being such that after a rotation of at most 90° in either direction from the position ready for rotation, the rotation shaft (15) is displaced a substantial amount towards the closed position, whereafter a rotary compulsory guidance takes place again, in which auxiliary compulsory guidance tracks (33, 33', 39) control the displacement of the rotation shaft (15) when the main cam (34) engages the straight sections (38), in such a manner that the vertical edges (23, 24) are proximate to and have clearance from the walls (21, 22, 26) of the housing.

8. Kitchen corner cupboard according to claim 3 wherein the vertical edges (23, 24) of the front element (18) project radially outwardly from the rotation axis (17) 10 to 15% further than the carrier plates (14*a*, 14*b*); and wherein the radial distance between the intersection line of the imaginary extensions of the front panels (41, 42) of the housing in the closed position of the front element (18) and the rotation axis (17) is preferably between 40 and 60% of the radial distance between the vertical edges (23, 24) and the rotation axis (17).

9. Kitchen corner cupboard according to claim 3 wherein the front member (18) is made of two front panels (19, 20) disposed at an angle ($\alpha$) of about 90°, the front panels being aligned with the front panel boards (41, 42) of the housing in the closed position and forming a corner (43) at their intersection line, the corner (43) lying on the diagonal (37).

10. A kitchen corner cupboard according to claim 9 wherein the front member (18) comprises substantially aligned, plane front panels (19, 20) connected to form a single piece, and wherein a vertical connection center line (43) of the front panels lies forwardly offset from the intersection line in the closed position.

11. Kitchen corner cupboard according to claim 3 wherein the side walls (21, 22) of the housing (12) are each provided with a chamfer (44) at their forward ends, the chamfer extending parallel to the diagonal (37) and permitting a diagonal displacement of the vertical edges (23, 24) along the chamfers (44).

12. A kitchen corner cupboard according to claim 3 including a blocking pin (60) for preventing the rotation of rotation shaft (15) when the rotation shaft is in a position other than in the position ready for rotation or in a position rotated with respect to said position ready for rotation.

13. A kitchen corner cupboard according to claim 12 wherein the blocking pin (60) is mounted at a predetermined location on the base plate (16) of the housing.

14. A kitchen corner cupboard according to claim 13 wherein the predetermined mounting location for the blocking pin (60) is on a side of the rotation shaft (15) facing the front member (18), the blocking pin being oriented in the diagonal direction (37).

15. A kitchen corner cupboard according to claim 14 wherein the rotation shaft (15) includes a transverse bore (61), and wherein the blocking pin (60) is arranged for progressively engaging the transfer bore during movement of the rotation shaft (15) from the position ready for rotation into the closed position to thereby lock the rotation shaft against rotation in the closed position and in all intermediate positions.

16. Method for opening and closing a kitchen corner cupboard including a housing (12) having an upper cover plate (11), side walls (21, 22), a rear wall (26), a base, and a carousel (13) mounted in the housing, the carousel having a vertical rotation shaft (15) onto which are mounted at least one horizontal carrier plate (14*a*, 14*b*), a front element (18) defined by first and second, angularly inclined front panels (19, 20) having a vertical edges (23, 24), the rotation shaft (15) being located at a substantial distance behind an intersecting line of imaginary extensions of angularly inclined front panel boards (41, 42) of the housing, the method comprising the steps of providing a translation body having means rotatably mounting the rotation shaft to the translation body, providing means mounting the translation body to the base and permitting relative movement between the base and the translation body, moving the translation body and therewith the carousel and the front element (18) firstly along a diagonal (37) rearwardly until the vertical edges (23, 24) of the front panels (19, 20) are sufficiently spaced from the side walls (21, 22) of the housing (12) to permit free rotation of the carousel, thereafter rotating the carousel (13) in one direction (2) or the other (3), until one of the vertical edges (23, 24) has come very close to the rear wall (26) and the other vertical edge (24, 23) has significantly passed a position nearest to one of the side walls (21 or 22), thereafter again moving the translation body and therewith the carousel towards the front until the at least one carrier plate (14*a*, 14*b*) is close to its foremost position, whereafter, when the carousel (13) is further rotated, the vertical edges (23, 24) pass along the rear wall (26) at a short distance therefrom, when the vertical edge (23 or 24) located in the front in the rotation direction has come close to a position (5 or 4) closest to a side wall (22, 21) of the housing, once again moving the translation body and therewith the carousel rearwardly, whereafter, upon further rotation the vertical edges (23, 24) are rotated into a front opening (45) of the housing (12) until the imaginary intersection line of the front panel boards (41, 42) of the housing determined with respect to the front element (18) in its closed position is located on the diagonal (37); and, to pull the front element (18) forwardly, moving the carousel (13) forwardly along the diagonal (37) until the front panels (19, 20) of the front element (18) adjoin the front panel boards (41, 42) of the housing.

17. Method according to claim 16, wherein the step of moving the translation body from the closed position, and moving the translation body from the position ready for rotation to the closed position includes applying a force bias in the diagonal direction, whereas all other positional changes of the carousel (13) are effected by exerting a rotation torque on the carousel (13) by means of compulsory guides (33, 33', 36, 39, 39').

* * * * *